US005816146A

United States Patent [19]

Wagner et al.

[11] Patent Number: 5,816,146

[45] Date of Patent: Oct. 6, 1998

[54] CALENDER FOR SATINING PAPER

[75] Inventors: Ulrich Wagner, Wachtendonk-Wankum; Dirk Cramer, Duisburg, both of Germany

[73] Assignee: Voith Sulzer Finishing GmbH, Krefeld, Germany

[21] Appl. No.: 805,745

[22] Filed: Feb. 25, 1997

[30] Foreign Application Priority Data

Feb. 28, 1996 [DE] Germany ..... 196 07 475.4

[51] Int. Cl.[6] ..... D21G 1/00

[52] U.S. Cl. ..... 100/327; 100/155 R; 100/162 B; 100/173

[58] Field of Search ..... 100/155 R, 161–167, 100/173, 327, 330, 331, 103

[56] References Cited

U.S. PATENT DOCUMENTS

| | | | |
|---|---|---|---|
| 124,048 | 2/1872 | Garfield | 100/173 |
| 222,081 | 11/1879 | Schlatter et al. | 100/162 R |
| 362,294 | 5/1887 | McCarthy | 100/173 |
| 364,710 | 6/1887 | Dunn | 100/166 |
| 454,322 | 6/1891 | Bacon | 100/166 |
| 1,504,727 | 8/1924 | Sheahan | 100/173 |
| 1,714,261 | 5/1929 | Egan et al. | 100/331 |
| 2,755,711 | 7/1956 | Moore | 100/166 |
| 4,192,080 | 3/1980 | Irpola | 100/330 |
| 4,332,191 | 6/1982 | Kankaanpaa | 100/162 R |
| 5,289,766 | 3/1994 | Conrad et al. . | |
| 5,483,873 | 1/1996 | Koivukunnas et al. | 100/173 |
| 5,542,349 | 8/1996 | Gosslinghoff | 100/173 |
| 5,609,098 | 3/1997 | Abe et al. | 100/331 |

FOREIGN PATENT DOCUMENTS

| | | |
|---|---|---|
| 3907216 | 9/1989 | Germany . |
| 4121381 | 6/1992 | Germany . |
| 51-33238 | 9/1976 | Japan . |
| 52-59706 | 5/1977 | Japan . |
| 4-136294 | 5/1992 | Japan . |
| 5-19399 | 3/1993 | Japan . |
| 7-65278 | 7/1995 | Japan . |

*Primary Examiner*—Stephen F. Gerrity
*Attorney, Agent, or Firm*—Greenblum & Bernstein, P.L.C.

[57] ABSTRACT

A calender for satining paper through roll gap formed between a heated hard roll and a soft roller having an elastic covering. Overheating of an edge region of the covering, i.e., the portion not covered by the paper to be satined, may be prevented by utilizing continuous insulation belts. The insulation belt may reduce the transmission of heat from the surface of the hard roll to the elastic covering, at least in the roller gap.

20 Claims, 1 Drawing Sheet

1
2
3
4
4'
5
6
7
8
8a
9
10
11
12
12a
13
13a
14
14a
15
15'
16
17
A
B
C
C1
a
b
d

CALENDER FOR SATINING PAPER

CROSS-REFERENCE OF RELATED APPLICATION

The present invention claims the priority under 35 U.S.C. § 119 of German Patent Application No. 196 07 475.4 filed on Feb. 28, 1996, the disclosure of which is expressly incorporated by reference herein in its entirety.

BACKGROUND OF THE INVENTION

1. Field of the Invention

The present invention relates to a calender for satining paper having a selectable paper sheet width. The calender may include at least one heatable hard roll and at least one soft roll having an elastic covering forming a roll gap, through which the paper sheet is guided. Because the sheet width is less than a cylinder width of the hard and soft rolls, a temperature difference may occur between the portions of the heated roll gap covered with the paper sheet and the portions of the heated roll gap that are outside of the dimensions of the paper sheet. The present invention ensures that a predetermined temperature difference, i.e., between the portions of the roll gap covered by the sheet and the portions of the roll gap not covered by the sheet, is not exceeded.

2. Discussion of the Background Information

In the current state of the art, high temperatures are utilized on the surface of the hard roller in calenders, however, the temperature stability of the elastic covering of the soft roller is often limited to values below this temperature. Thus, it is necessary to ensure that the elastic covering is not overheated by the extreme temperature of the hard roll surface. Overheating may be minimized when the a heat-dissipating paper sheet is guided through the roll gap, however, the benefit is generally only in the area covered by the paper sheet. Those portions of the elastic covering located outside the area covered by the paper sheet may remain at risk for overheating, which may adversely effect the elastic covering, the roll gap, the calender, and the paper sheet to be satined.

To avoid the above-noted risk of overheating, DE 39 07 216 A1 suggests guiding a paper sheet, having a width at least as great as the width of the elastic covering, through the roll gap. However, a non-calendered edge strip remains on the paper sheet which must be cut off and removed. In calenders having a plurality of roll gaps, the non-satined edges can lead to sheet travel problems. Further, this technique is not practicable if paper sheets of different widths are to be produced.

An alternative known arrangement, e.g., disclosed in DE 41 21 381 C1, may include maintaining a paper sheet width smaller than a width of the soft roll and cooling the uncovered portion of the elastic covering by applying a thin and sharply delimited water film. A cooling device is moved parallel to the roller and is adaptable to varying paper sheet widths. However, the cooling devices and temperature measurement systems required for this arrangement are expensive, unreliable, and not effective enough at high surface temperatures.

SUMMARY OF THE INVENTION

An object of the invention is to provide effective protection for the elastic covering of the soft roll from overheating which may be achieved in a simple manner and may be adaptable with varying paper sheet widths.

According to the present invention, continuous insulation belts may be utilized to reduce heat transmission from the heated surface of the hard roll, i.e., at least in the roll gap. The continuous insulation belts may be positioned to cover the edge regions of the elastic covering that is not covered by the paper sheet.

The continuous insulation belts may protect the regions of the elastic covering outside the dimensions of the guided paper sheet from overheating. For example, the insulating characteristics of the insulation belts may prevent the transmission of excessive heat from the heated surface of the hard roll to the covering. Further, the continuous insulation belt may be utilized as a support that prevents the heated surface of the hard roll from coming too close to, or in contact with, the elastic covering. Thus, the insulation belts may be utilized to simulate an additional paper sheet disposed adjacent the paper sheet to be satined as it passes through the roll gap.

In a particular embodiment of the present invention, the endless insulation belts which may be guided by at least one deflection roller and may be stretched by a tensioning device. The insulation belts may wind around an associated roll, e.g., contacting only a part of the roll surface circumference, and may be guided through a predefined path by one or a plurality of deflection rollers. In so doing, heat on the insulation belts may be dissipated by the surrounding air and/or by a cooling device. The tensioning device ensures that the insulation belts may be positioned to rest smoothly against the associated roll, i.e., one of the hard roll and the soft roll. Further, the tensioning device enables the insulation belt to be driven by the associated roll, thus, not requiring a separate drive mechanism.

In a particular embodiment, the insulation belts may wind around the hard roll. This arrangement may be particularly suitable when, due to the oxbow effect, the cylindrical portion of the hard roll may have a greater width than the width of the cylindrical part of the elastic covering. This arrangement produces a particularly favorable support.

According to a particular alternative arrangement of the present invention, the insulation belts may wind around the elastic covering of the soft roll. This arrangement may considerably reduce the heat load of the insulation belt.

In general, the insulation belts may not be as thick as the paper sheet guided through the roll gap. This ensures that the insulation belts do not impermissibly alter the compressive strain of the roll gap on the outer edges of the guided paper sheet.

Further, the insulation belts utilized by the present invention may have a lower deformation resistance than the paper sheet. This feature may ensure that the insulation belt may be more easily compressed than the paper sheet and, therefore, may have no negative influence on the satining of the paper sheet.

The insulation belts of the present invention may be made of a fiber reinforced plastic material. The material of the insulation belts may be selected in accordance with the contemplated temperatures to be exhibited on the surface of the hard roll. This selection may advantageously reduce the possibility of overheating.

In a further embodiment, the width of the insulation belts may be selected to ensure that they do not protrude beyond the outer edges of the cylindrical portion of the hard roll or of the cylindrical portion of the elastic covering of the soft roll. This arrangement may ensure that the paper sheet will be properly guided and reduce the changes of any variations from the intended path through the roll gap.

In another embodiment, a detection device may be provided to detect a position of the sheet edges. This information may be utilized for determining the width needed for the insulation belts and their respective positioning in the roll gap.

In another particular embodiment of the present invention, the calender may also include a deflection adjustment roll having zone control for adjusting the pressure in various zones associated with the roll. The pressure in each of the various zones may be individually adjusted in relation to each of the other zones. Thus, a desired compressive strain profile may be predefined and/or set with a high degree of precision, even when paper sheets of different widths are to be processed.

The present invention may be directed to a calender for satining a paper sheet having a determinable width. The calender may include at least one heatable hard roll; at least one soft roll having an elastic covering; and at least one roll gap formed between the at least one heatable hard roll and the at least one soft roll. The at least one roll gap may have a width sufficient to receive the paper sheet. The calender may also include continuous insulation belts that reduce heat transmission, and, within the at least one roll gap, that cover an outer surface of the soft roll not covered by the paper sheet.

In accordance with another feature of the present invention, the continuous insulation belts may include endless insulation belts that may be guided by at least one deflection roll and that may be stretched by a tensioning device.

In accordance with another feature of the present invention, the insulation belts may be positioned to wind around at least a portion of the hard roll.

In accordance with a further feature of the present invention, the insulation belts may wind around at least a portion of the covering.

In accordance with still another feature of the present invention, the insulation belts may include a thickness less than a thickness of the paper sheet.

In accordance with yet another feature of the present invention, the insulation belts may include a lower deformation resistance than the deformation resistance of the paper sheet.

In accordance with a still further feature of the present invention, the insulation belts may include a fiber reinforced plastic.

In accordance with another feature of the present invention, the insulation belts may include a width such that an outer edge of each insulation belt does not extend beyond one of an outer edge of a cylindrical portion of the hard roll and an outer edge of a cylindrical portion of the covering.

In accordance with another feature of the present invention, the calender may further include a detection device that detects a position of each edge of the paper sheet and that determines a width of the insulation belts and where to position the insulation belt in the roll gap.

In accordance with still another feature of the present invention, the soft roll may include a deflection adjustment roll having zone control and a pressure exerted in zones associated with the insulation belts that may be reduced in relation to the other zones.

The present invention may also be directed to a calender for satining a paper sheet that includes a first cylinder having a first width; a second cylinder having a second width; the first and second cylinder forming a gap for satining the paper sheet and the first and second width being greater than a sheet width of the paper sheet. One of the first and second cylinder may include a deformable outer cover and at least one insulation layer may be positionable adjacent to an edge of the paper sheet and within the gap to ensure separation of the first and second cylinder.

In accordance with another feature of the present invention, the insulation layer may include a pair of insulation belts, each insulation belt being positionable adjacent a respective paper sheet edge within the gap.

In accordance with a further feature of the present invention, each insulation belt may include a width extending no more than between the respective paper sheet edge and an outer edge of one of the first and second cylinder and each insulation belt may be axially inserted onto one of the first and second cylinder.

In accordance with still another feature of the present invention, the calender may further include a deflection roll and a tensioning device. The insulation belt may be guided around at least a portion of a circumference of one of the first and second cylinder and around at least a portion of the deflection roll. The tensioning device may adjustably stretch the insulation belt.

In accordance with a further feature of the present invention, the one roll may include a deflection adjustment roll including a plurality of independently actuated pressure zones. The pressure zones may include an inner zone including pressure zones positioned adjacent the paper sheet in the gap and at least one outer zone including pressure zones positioned adjacent the portion of the one roll and outside the edge of the paper sheet.

In accordance with yet another feature of the present invention, the insulating layer may have a higher temperature threshold than the deformable outer cover.

Further embodiments and advantages can be seen from the detailed description of the present invention and the accompanying figures.

BRIEF DESCRIPTION OF THE DRAWINGS

The present invention is further described in the detailed description which follows, in reference to the noted drawings by way of non-limiting examples of preferred embodiments of the present invention, wherein same reference numerals represent similar parts throughout the several views of the drawings, and wherein.

DETAILED DESCRIPTION OF THE PREFERRED EMBODIMENTS

Figures 1, 2, 3, 4:
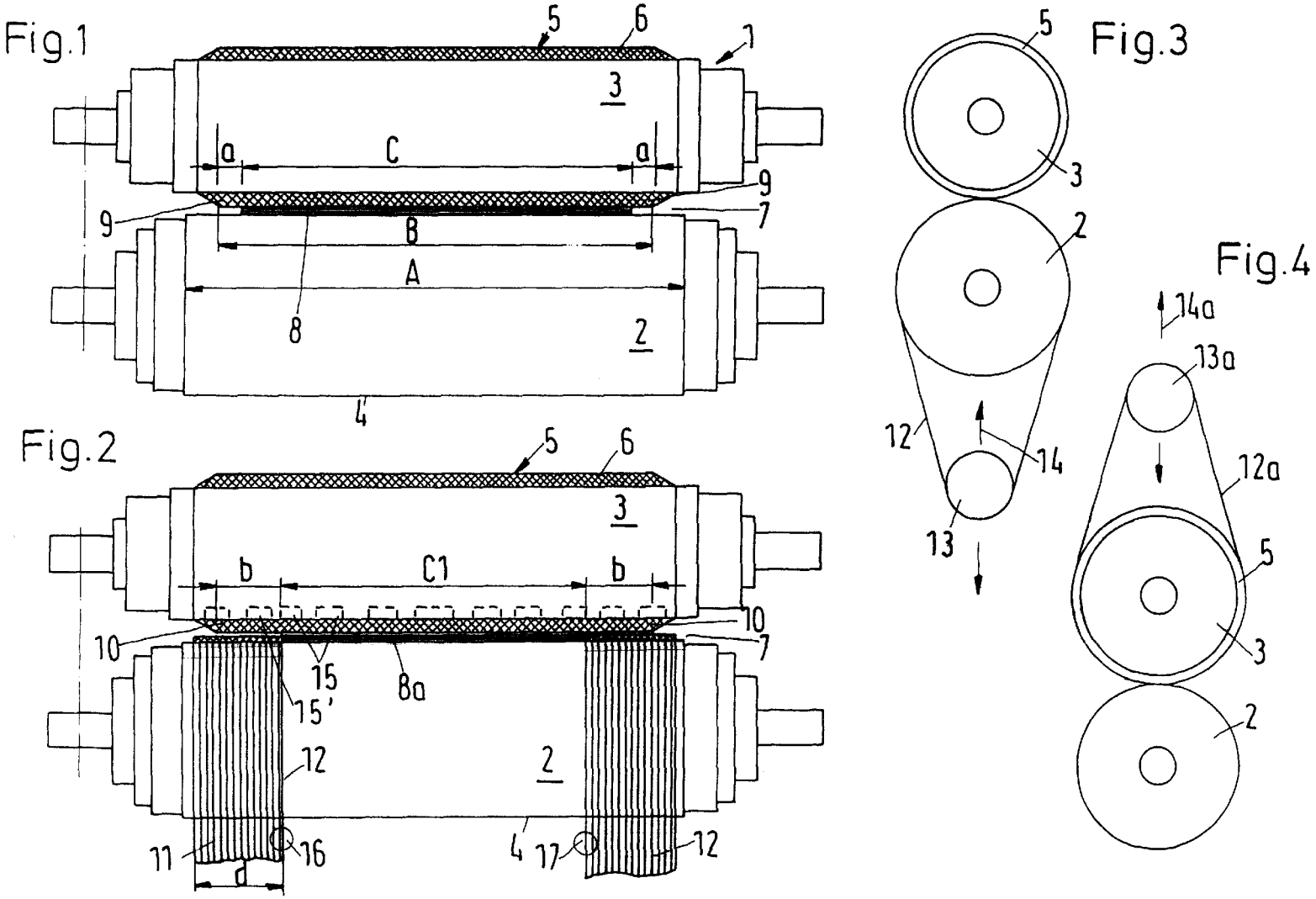
FIG. 1 illustrates a two-roll calender for processing a paper sheet having a maximal width.
FIG. 2 illustrates the two-roll calender depicted in FIG. 1 processing a narrower paper sheet.
FIG. 3 illustrates a side view of the two-roll calender depicted in FIG. 2.
FIG. 4 illustrates a side view of an alternative embodiment of the two-roll calender depicted in FIG. 2.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

A two-roller calender, illustrated in FIGS. 1–3 may include a hard roll 2 and a soft roll 3. Hard roll 2 may include a cylindrical part 4 having a width A. Hard roll 2 may also have an outer heatable surface that may be heated in a substantially even manner over the entire width, e.g., with heating oil conducted near the outer surface through bores parallel to the axis, by means of an electrical heating device or the like. Soft roll 3 may carry a covering 5 having a cylindrical part 6 with a width B. In accordance with FIG. 1, width B is smaller than width A, however, the present invention contemplates utilizing widths having other values.

Roll 2 and 3 may be urged together to form a roll gap 7, through which a paper sheet 8, having a maximal width C, is guided to be satined. At roll gap 7, covering 5 may include a free edge region 9, located adjacent to at least one, but generally each, edge of paper sheet 8. Region 9 may include a width a, e.g., approximately 10 or 15 mm or less, that may be maintained, separated from the heated surface of hard roll 2, due to the thickness of paper sheet 8. Thus, the outer surface of covering 5 within region 9 is not directly in contact with the heated surface and, thus, avoiding unintentional damage. In other words, width a is a predetermined maximum that ensures separation of the surfaces of the hard and soft rolls. Width a may be related to, e.g., the material covering the soft roll, the manner in which the soft and hard rolls are forced against each other, etc.

FIG. 2 illustrates an arrangement substantially similar to the arrangement depicted in FIG. 1, except that the paper sheet 8*a* guided through the roll gap 7 may have a width of C1, which may be less than width C of FIG. 1. Because width C1 is reduced in relation to width C of the exemplary arrangement of FIG. 1, free edge regions 10 may be formed on the outer surface of covering 5 adjacent the outer edges of paper sheet 8*a*, i.e., between the outer edges of paper sheet 8*a* and the outer edges of cylinder 6, to have a width b. Because width b is greater than width a, the outer surface of covering 5 extends over the paper sheet beyond the predetermined width ensuring separation from the heated surface of hard roll 2. Thus, the surface of covering 5 within free edge region 10 may be damaged due to overheating and/or contacting the heated surface of hard roll 2.

To prevent this undesired contact, two insulation belts 11, which may be partially wind around hard roll 2, as shown in FIG. 3, may be utilized by the calender. Each insulation belt 11 may have a width d that substantially covers regions 10 completely. Insulation belts 11 may adjoin an outer edge 12 of the paper sheet 8*a* and, preferably, do not extend beyond an outer edge of cylindrical portion 4. The introduction of insulation belts 11 on cylindrical portion 4 may protect region 10 from excessive heating and may ensure reliable travel and driving of the insulation belts. Insulation belts 11 may be made of, e.g., a fiber reinforced plastic having a higher temperature stability than covering 5, i.e., sufficient to withstand temporarily contacting at least the partially wound surface of hard roll 2 as the insulation belt is rotated. Insulation belts 11 may be selected so as not to be as thick as the paper sheet being guided through roll gap 7. This ensures that the insulation belts do not impermissibly alter the compressive strain of the roll gap on the outer edges of the guided paper sheet. Further, the material for the insulation belts 11 may be selected to exhibit a lower deformation resistance than the paper sheet. This feature may ensure that the insulation belt may be more easily compressed than the paper sheet and, therefore, may have no negative influence on the satining of the paper sheet.

The present invention may also include a pair of detection devices 16 and 17 that detect the paper sheet edges. Width B of insulation belts 11 may be determined in accordance with the edge detection. The detection devices, e.g., photocells, etc., may also be utilized to determine how far, i.e., axially inward, the insulation belts should be moved to position the insulation belts adjacent the respective edges of paper sheet 8*a* for optimum performance. According to the present invention, as soon as the outer edges of paper sheet 8*a* have been detected by detection devices 16 and 17, insulation belts 11 may be axially moved inward, i.e., into roll gap 7 from a position outside roll gap 7. Once insulation belt 11 is in place, roll gap 7 may be closed, i.e., the hard roll may be biased against the soft roll and operation of the calender may begin. If, during the production process the width of sheet 8*a* were to change, i.e., beyond a permissible predetermined tolerance range, insulation belts 11 would have to be correspondingly repositioned.

FIG. 3 illustrates an arrangement of insulation belt 11 with respect to calender 1. Insulation belt 11 may be an endless insulation belt that winds around a portion of hard roll 2, e.g, more than one-half of the circumference of the roll, and may be conveyed (guided) by a deflection roll 13. Deflection roll 13 may stretch insulation belt 11 through a tensioning device 14, which may move deflection roll 13 in the directions indicated by arrows 14. Thus, insulation belt 11 may be driven by the rotation of hard roll 2. Accordingly, along the path of insulation belt 11, portions of insulation belt 11 contact hard roll 2 and are heated, however, these heated portions are also subsequently exposed to the free atmosphere for cooling purposes. Additionally, if more cooling is necessary, a cooling device may also be utilized to further cool insulation belt 11.

An alternative to the arrangement of FIG. 3 may be illustrated in FIG. 4. In this alternative, insulation belt 11*a* may be wound around elastic covering 5 of soft roll 3. Further, a tensioning device 14*a* may be utilized to stretch covering 5 in a manner similar to tensioning device 14 in FIG. 3. Insulation belt 11*a* may be driven by rotation soft roll 3.

Referring again to FIG. 2, soft roll 3 has been schematically represented, e.g., as a deflection adjustment roller having a series of zones 15. Each zone may be supplied with a predetermined pressure fluid and the supply for each zone may be independent of the supply in any other zones. Each zone may be comprised of, e.g., a hydrostatic support element or a plurality of such hydrostatic support elements. Zones 15' may be designated as the zones located within the region covered by insulation belts 11 which may be acted upon by lower pressure than the other support elements.

Thus, the pressure in each zone 15 may be individually adjusted relative to each of the other zones. Thus, a desired compressive strain profile over the width of the cylinder 6 may be predefined and/or set with a high degree of precision, even when paper sheets of different widths are to be processed.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A calender for satining a paper sheet having a determinable width, the calender comprising:

at least one heatable hard roll;

at least one soft roll having an elastic covering;

at least one roll gap formed between the at least one heatable hard roll and the at least one soft roll, the at least one roll gap having a width sufficient to receive the paper sheet; and continuous insulation belts that reduce heat transmission, and, within the at least one roll gap, that cover an outer surface of the soft roll not covered by the paper sheet.

2. The calender according to claim 1, the continuous insulation belts comprising endless insulation belts guided by at least one deflection roll and stretched by a tensioning device.

3. The calender according to claim 1, the insulation belts positioned to wind around at least a portion of the hard roll.

4. The calender according to claim 1, the insulation belts wind around at least a portion of the covering.

5. The calender according to claim 1, the insulation belts comprising a thickness less than a thickness of the paper sheet.

6. The calender according to claim 1, the insulation belts comprising a lower deformation resistance than the deformation resistance of the paper sheet.

7. The calender according to claim 1, the insulation belts comprising a fiber reinforced plastic.

8. The calender according to claim 1, the insulation belts comprising a width such that an outer edge of each insulation belt does not extend beyond one of an outer edge of a cylindrical portion of the hard roll and an outer edge of a cylindrical portion of the covering.

9. The calender according to claim 1, further comprising a detection device that detects a position of each edge of the paper sheet and that determines a width of the insulation belts and where to position the insulation belt in the roll gap.

10. The calender according to claim 1, the soft roll comprising a deflection adjustment roll having zone control; and a pressure exerted in zones associated with the insulation belts being reduced in relation to the other zones.

11. A calender for satining a paper sheet comprising:

a first cylinder having a first width;

a second cylinder having a second width;

said first and second cylinders forming a gap for satining the paper sheet, said first and second width being greater than a sheet width of the paper sheet;

one of said first and second cylinders comprising a deformable outer cover; and at least one insulation layer positionable adjacent to an edge of the paper sheet and within said gap to ensure separation of the first and second cylinders.

12. The calender according to claim 11, the insulation layer comprising a pair of insulation belts, each insulation belt positionable adjacent a respective paper sheet edge within the gap.

13. The calender according to claim 12, each insulation belt comprising a width extending no more than between the respective paper sheet edge and an outer edge of one of the first and second cylinders; and each insulation belt being axially inserted onto one of said first and second cylinders.

14. The calender according to claim 12, further comprising a first and second detection device that detect a location of the respective sheet edges with respect to the calender; and the insulation belts positionable in accordance with the detected location of the respective sheet edges.

15. The calender according to claim 12, said insulation belt comprising a fiber reinforced plastic material.

16. The calender according to claim 12, said insulation belt comprising a thickness less than a thickness of the paper sheet.

17. The calender according to claim 12, said insulation belt comprising a deformation resistance lower than the deformation resistance of the paper sheet.

18. The calender according to claim 12, further comprising:

a deflection roll;

a tensioning device;

said insulation belt being guided around at least a portion of a circumference of one of the first and second cylinders and around at least a portion of the deflection roll; and said tensioning device adjustably stretching the insulation belt.

19. The calender according to claim 11, said one of said first and second cylinders comprising a deflection adjustment roll, the deflection adjustment roll including a plurality of independently actuated pressure zones; and said pressure zones comprising an inner zone including pressure zones positioned adjacent the paper sheet in the gap and at least one outer zone including pressure zones positioned adjacent the portion of the deflection adjustment roll and outside the edge of the paper sheet.

20. The calender according to claim 11, said insulating layer having a higher temperature threshold than said deformable outer cover.

* * * * *